US010276100B2

(12) United States Patent
Huangfu et al.

(10) Patent No.: US 10,276,100 B2
(45) Date of Patent: Apr. 30, 2019

(54) PIXEL CIRCUIT AND DRIVING METHOD, ARRAY SUBSTRATE, DISPLAY PANEL, AND DISPLAY DEVICE

(71) Applicant: BOE TECHNOLOGY GROUP CO., LTD., Beijing (CN)

(72) Inventors: Lujiang Huangfu, Beijing (CN); Zhanjie Ma, Beijing (CN); Lintao Zhang, Beijing (CN); Tuo Sun, Beijing (CN); Zheng Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 24 days.

(21) Appl. No.: 15/531,561

(22) PCT Filed: Nov. 11, 2016

(86) PCT No.: PCT/CN2016/105418
§ 371 (c)(1),
(2) Date: May 30, 2017

(87) PCT Pub. No.: WO2017/173822
PCT Pub. Date: Oct. 12, 2017

(65) Prior Publication Data

US 2018/0218683 A1 Aug. 2, 2018

(30) Foreign Application Priority Data

Apr. 6, 2016 (CN) ..... 2016 1 0211399

(51) Int. Cl.
*G09G 3/3233* (2016.01)
*G09G 3/3258* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC .. G09G 3/3258; G09G 3/3233; G09G 3/3241; G09G 3/325; G09G 3/32
See application file for complete search history.

(56) References Cited

U.S. PATENT DOCUMENTS 7,978,156 B2 7/2011 Kim
8,629,864 B2 1/2014 Miwa et al.
(Continued)

FOREIGN PATENT DOCUMENTS

CN 101828213 A 9/2010
CN 103137062 A 6/2013
(Continued)

OTHER PUBLICATIONS

The World Intellectual Property Organization (WIPO) International Search Report and Written Opinion for PCT/CN2016/105418 dated Jan. 25, 2017 13 Pages.
(Continued)

*Primary Examiner* — Alexander Eisen
*Assistant Examiner* — Cory A Almeida
(74) *Attorney, Agent, or Firm* — Westerman, Hattori, Daniels & Adrian, LLP

(57) ABSTRACT

A pixel circuit and driving method, an array substrate, a display panel, and a display device are provided. The pixel circuit includes a voltage clamping unit, an energy storage unit, and a reference voltage terminal. The voltage clamping unit connects to the reference voltage terminal and a first terminal of the energy storage unit. The voltage clamping unit forms a voltage divider circuit to supply a divided reference voltage from the reference voltage terminal to the first terminal of the energy storage unit or pulls and clamps the voltage at the first terminal of the energy storage unit to a reference voltage at the reference voltage terminal.

18 Claims, 6 Drawing Sheets

(52) U.S. Cl.
CPC ..... *G09G 2300/0842* (2013.01); *G09G 2300/0861* (2013.01)

(56) References Cited

U.S. PATENT DOCUMENTS

| | | | | |
|---|---|---|---|---|
| 8,803,770 | B2 | 8/2014 | Jeong et al. | |
| 2007/0085781 | A1 | 4/2007 | Chung et al. | |
| 2010/0277455 | A1* | 11/2010 | Miwa | G09G 3/3233 345/211 |
| 2011/0164071 | A1 | 7/2011 | Chung et al. | |
| 2011/0227889 | A1 | 9/2011 | Choi | |
| 2012/0235972 | A1* | 9/2012 | Liu | G09G 3/3233 345/211 |

FOREIGN PATENT DOCUMENTS

| | | | |
|---|---|---|---|
| CN | 103903564 | A | 7/2014 |
| CN | 103943066 | A | 7/2014 |
| CN | 203882587 | U | 10/2014 |
| CN | 203882588 | U | 10/2014 |
| CN | 204029330 | U | 12/2014 |
| CN | 102314829 | B | 4/2015 |
| CN | 104599631 | A | 5/2015 |
| CN | 105679250 | A | 6/2016 |
| CN | 205722741 | U | 11/2016 |
| KR | 100703492 | B1 | 4/2007 |
| KR | 10-2010-0089084 | A | 8/2010 |
| WO | 2017173822 | A1 | 10/2017 |

OTHER PUBLICATIONS

State Intellectual Property Office of the P.R.C (SIPO) Office Action 1 for 201610211399.7 dated Oct. 11, 2017 27 Pages.

Office Action dated Dec. 28, 2018, issued in counterpart Korean Application No. 10-2017-7013789, with English translation. (15 pages).

* cited by examiner

PIXEL CIRCUIT AND DRIVING METHOD, ARRAY SUBSTRATE, DISPLAY PANEL, AND DISPLAY DEVICE

CROSS-REFERENCES TO RELATED APPLICATION

This application is a national phase entry under 35 U.S.C. § 371 of PCT patent application No. PCT/CN2016/105418, filed on Nov. 11, 2016, which claims the priority of Chinese Patent Application No. 201610211399.7, filed on Apr. 6, 2016, the entire contents of both of which are incorporated herein by reference.

TECHNICAL FIELD

The present disclosure generally relates to display technologies and, more particularly, relates to a pixel circuit and driving method, an array substrate, a display panel, and a display device.

BACKGROUND

Mobile terminal displays such as active matrix organic light emitting diode (AMOLED) often use low temperature poly-silicon thin film transistor (LTPS TFT) as a basic driving component in the driving circuit of array substrate. Generally, LTPS technology inherently makes TFT threshold voltages (Vth) discretely inconsistent. Because OLED pixel driving TFTs directly control driving current and brightness of OLED display, inconsistency in the threshold voltage may often cause undesired effect on image quality.

Using pixel circuit having Vth compensation function is often an effective way to improve the Vth discrete inconsistency. When an OLED driving TFT in such circuit is functioning, a driving signal written to the TFT gate electrode includes two components: a pixel OLED light emission brightness signal and a threshold voltage (Vth) compensation signal based on the driving TFT characteristics. This approach is similar to thin film transistor liquid crystal display (TFT-LCD), which generally includes two components in a driving signal and maintains the voltage level by a storage capacitor in a display frame period.

Alternatively, the pixel brightness signal is often generated by a driving integrated circuit (DrIC) and is written to the storage capacitor while the driving TFT Vth compensation signal is incrementally written to the storage capacitor by shorting between a gate electrode and a drain electrode of the driving TFT during a refreshing phase. Based on the two different means of supplying pixel brightness signal to the storage capacitor, pixel circuits are divided into two technical categories.

SUMMARY

The present disclosure provides a pixel circuit and a pixel circuit driving method, an array substrate, a display panel, and a display device to improve pixel circuit operation stability and image quality.

In one aspect, the present disclosure provides a pixel circuit. The pixel circuit includes a voltage clamping unit, an energy storage unit, and a reference voltage terminal. The voltage clamping unit is configured to connect to the reference voltage terminal and a first terminal of the energy storage unit. The voltage clamping unit is configured to form a voltage divider circuit to supply a divided reference voltage from the reference voltage terminal to the first terminal of the energy storage unit or to pull and clamp the voltage at the first terminal of the energy storage unit to a reference voltage at the reference voltage terminal.

Optionally, the voltage clamping unit includes a clamping resistor; a first terminal of the clamping resistor is configured to connect to the reference voltage terminal; and a second terminal of the clamping resistor is configured to connect to the first terminal of the energy storage unit.

Optionally, the pixel circuit further includes a reset unit. The reset unit is configured to connect a reset control terminal, a second terminal of the energy storage unit, and a reset voltage terminal together; and controlled by the reset control terminal, the resent unit is configured to write a signal at the reset voltage terminal to the second terminal of the energy storage unit.

Optionally, the pixel circuit further includes a data write unit. The data write unit is configured to connect a data signal terminal, a data write control terminal, and the first terminal of the energy storage unit together; and controlled by the data write control terminal, the data write unit is configured to write a divided signal at the data signal terminal to the first terminal of the energy storage unit.

Optionally, the pixel circuit further includes a compensation unit. The compensation unit is configured to connect the data write control terminal, a second terminal of the energy storage unit, and a driving terminal together; and controlled by the data write control terminal, the compensation unit is configured to pull a voltage at the second terminal of the energy storage unit to a same level as a voltage at the driving terminal.

Optionally, the pixel circuit further includes a driving unit. The driving unit is configured to connect a first voltage terminal, a second terminal of the energy storage unit, and the driving terminal together; and controlled by the second terminal of the energy storage unit and the first voltage terminal, the driving unit is configured to output a driving signal to the driving terminal.

Optionally, the pixel circuit further includes a light emitting unit. The light emitting unit is configured to connect a light emitting control signal terminal, the driving terminal, and a second voltage terminal together; and controlled by the light emitting control signal terminal, the light emitting unit is configured to receive the driving signal from the driving terminal to display a gray scale.

Optionally, the voltage clamping unit also connects to the light emitting control signal terminal; and controlled by the light emitting control signal terminal, the voltage clamping unit is configured to pull the voltage at the first terminal of the energy storage unit to a same level as a voltage level at the reference voltage terminal.

Optionally, the reset unit includes a second transistor; a control terminal of the second transistor connects to the reset control terminal; a first terminal of the second transistor connects to the reset voltage terminal; and a second terminal of the second transistor connects to the second terminal of the energy storage unit.

Optionally, the data write unit includes a fourth transistor, a control terminal of the fourth transistor connects to the data write control terminal; a first terminal of the fourth transistor connects to the data signal terminal; and a second terminal of the fourth transistor connects to the first terminal of the energy storage unit.

Optionally, the compensation unit includes a third transistor; a control terminal of the third transistor connects to the data write control terminal; a first terminal of the third transistor connects to the driving terminal; and a second terminal of the third transistor connects to the second terminal of the energy storage unit.

Optionally, the driving unit includes a first transistor; a control terminal of the first transistor connects to the second terminal of the energy storage unit; a first terminal of the first transistor connects to the first voltage terminal; and a second terminal of the first transistor connects to the driving terminal.

Optionally, the light emitting unit includes a fifth transistor and an organic light emitting diode; a control terminal of the fifth transistor connects to the light emitting control signal terminal; a first terminal of the fifth transistor connects to the driving terminal; a second terminal of the fifth transistor connects to a first terminal of the organic light emitting diode; and a second terminal of the organic light emitting diode connects to the second voltage terminal.

Optionally, the energy storage unit includes a capacitor; a first terminal of the capacitor connects to a second terminal of the energy storage unit; and a second terminal of the capacitor connects to the first terminal of the energy storage unit.

Optionally, the voltage clamping unit includes a clamping resistor and a sixth transistor; a first terminal of the clamping resistor connects to the reference voltage terminal; a second terminal of the clamping resistor connects to the first terminal of the energy storage unit; a control terminal of the sixth transistor connects to the light emitting control signal terminal; a first terminal of the sixth transistor connects the reference voltage terminal; and a second terminal of the sixth transistor connects to the first terminal of the energy storage unit.

In another aspect, the present disclosure provides an array substrate. The array substrate includes a disclosed pixel circuit.

In another aspect, the present disclosure provides a display panel. The display panel includes a disclosed pixel circuit.

The voltage clamping unit is a clamping resistor having a resistance value selected to satisfy one or more of a first condition and a second condition. The first condition includes $R_c >> R_{in}$, where $R_c$ is the resistance value of the clamping resistor, and $R_{in}$ is an accumulative internal resistance in the pixel circuit before the first terminal of the energy storage unit. The second condition includes $R_c << T_{frame}/(C_{pA}+C_{pB})$, where $R_c$ is the resistance value of the clamping resistor, $T_{frame}$ is a frame period, $C_{pA}$ is a parasitic capacitance at the second terminal of the energy storage unit, and $C_{pB}$ is a parasitic capacitance at the first terminal of the energy storage unit.

In another aspect, the present disclosure provides a display device. The display device includes a disclosed display panel.

In another aspect, the present disclosure provides a driving method for the disclosed pixel circuit. In the driving method, a voltage clamping unit is used to divide a voltage at a first terminal of an energy storage unit in a pixel circuit. The voltage clamping unit is also used to drive and maintain the voltage at the first terminal of the energy storage unit to a same level as a voltage at the reference voltage terminal.

Optionally, the method further includes using a reset unit, under a control of a reset control terminal, to write a voltage at a reset voltage terminal into a second terminal of an energy storage unit; using a data write unit, under a control of a data write control terminal, to write a divided signal voltage at a data signal terminal into a first terminal of the energy storage unit; using a voltage clamping unit to divide a signal voltage that the data signal terminal writes at the first terminal of the energy storage unit; using a compensation unit, under a control of the data write control terminal, to drive the voltage at the second terminal of the energy storage unit to a same level as a voltage at a driving terminal, and using the energy storage unit to store the voltages at the first terminal and the second terminal of the energy storage unit; and using a driving unit, under a control of the second terminal of the energy storage unit, to write a voltage at a first voltage terminal into the driving terminal as a driving signal, and using a light emitting unit, under a control of a light emitting control signal terminal, to receive the driving signal at the driving terminal to display a gray scale.

Optionally, the reset unit includes a second transistor; and in step (a), controlled by the reset control terminal, the second transistor turns on, and writes a voltage at the reset voltage terminal into the second terminal of the energy storage unit.

Optionally, the compensation unit includes a third transistor; and in step (b), controlled by the data write control terminal, the third transistor turns on, and pulls the voltage at the second terminal of the energy storage unit to a same level as the voltage at the driving terminal.

Optionally, the data write unit includes a fourth transistor; and in step (b), controlled by the data write control terminal, the fourth transistor turns on, and writes the voltage at the data signal terminal to the first terminal of the energy storage unit.

Optionally, the light emitting unit includes a fifth transistor and an organic light emitting diode; in step (c), controlled by the light emitting control signal terminal, the fifth transistor turns on, and receives the driving signal from the driving terminal; and in step (c), controlled by the driving signal and the signal at the second voltage terminal, the organic light emitting diode displays a gray scale.

Optionally, the voltage clamping unit includes a clamping resistor; in step (b), the clamping resistor divides the voltage at the first terminal of the energy storage unit; and in step (c), the clamping resistor pulls the voltage at first terminal of the energy storage unit to the voltage level at the reference voltage terminal.

Optionally, the voltage clamping unit includes a clamping resistor and a sixth transistor; in step (b), the clamping resistor divides the voltage at the first terminal of the energy storage unit; and in step (c), controlled by the light emitting control signal terminal, the sixth transistor turns on, shorts the clamping resistor, and pulls the voltage at the first terminal of the energy storage unit to the voltage level at the reference voltage terminal.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

The disclosure will now describe more specifically with reference to the following embodiments. It is to be noted that the following descriptions of some embodiments are presented herein for purpose of illustration and description only. It is not intended to be exhaustive or to be limited to the precise form disclosed.

Figure 1:
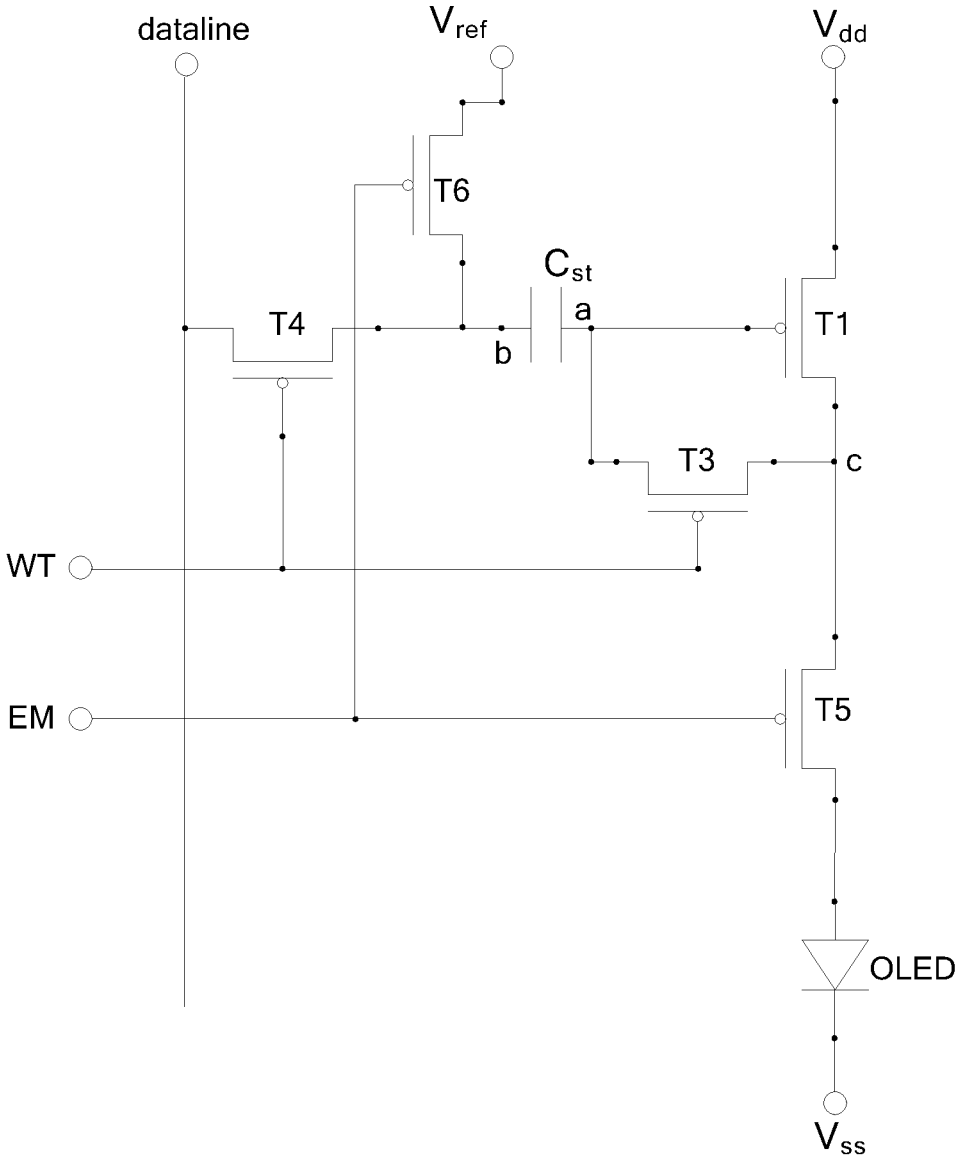
FIG. 1 ( Prior Art )
FIG. 1 is a schematic diagram illustrating a conventional pixel circuit.
Figure 2:
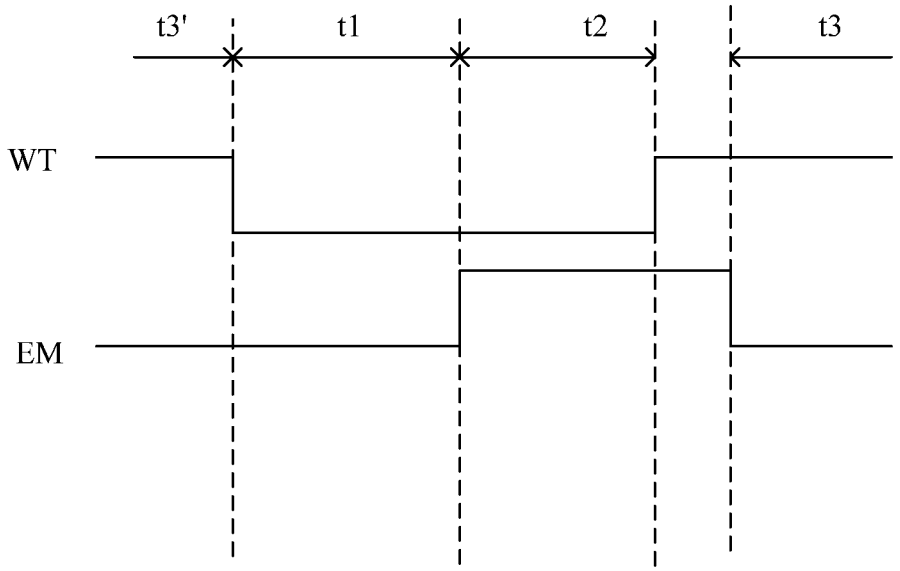
FIG. 2 ( Prior Art )
FIG. 2 is a timing diagram illustrating a driving signal of the pixel circuit shown in FIG. 1.

FIG. 1 is a schematic diagram illustrating a conventional pixel circuit. FIG. 2 is a timing diagram illustrating a driving signal of the pixel circuit shown in FIG. 1. As shown in FIG. 2, when a column signal refreshes, a reset phase (t1) resets a driving circuit state and a signal level maintained by a storage capacitor (Cst) of last signal frame. In the reset phase (t1), a voltage at terminal a may be pulled down to allow writing a Vth compensation signal. At the same time, a pixel OLED driving TFT (T1) as shown in FIG. 1 turns on to increase a response speed in a writing phase (t2).

In the writing phase (t2), the Vth compensation signal of the pixel OLED driving thin film transistor (TFT) T1 and the pixel brightness signal Vdt are written to both terminals (terminal a and terminal b) of the storage capacitor Cst. The driving power supply Vdd is connected to a source electrode of transistor T1. The gate electrode and the drain electrode of transistor T1 are shorted by a transistor T3 in on state, and are connected to the terminal a of the storage capacitor Cst.

When the power supply Vdd is charging the terminal a of the storage capacity Cst through transistor T1, the voltage at the shorted gate electrode and drain electrode of transistor T1, and the terminal a of the storage capacitor Cst is approaching Vth to complete the writing and to maintain the voltage at the terminal a of the storage capacitor Cst. At the same time, the pixel brightness signal Vdt from the data line is written to and maintained at the terminal b of the storage capacitor Cst through a writing transistor T4.

In a light emitting phase (t3), a writing pulse (WT) signal controls the transistors T3 and T4 in off state, and a light emitting enable pulse (EM) signal controls the transistors T5 and T6 in on state. The voltage at the terminal b of the storage capacitor Cst is reset to a reference voltage Vref by the reset transistor T6. Coupled by the storage capacitor Cst, the voltage at the terminal a changes accordingly from Vth to Vth+Vref−Vdt, which turns on the transistor T1 to drive the pixel OLED to emit light.

The pixel OLED driving circuit includes a voltage reset circuit to reset the voltage at the terminal b of the storage capacitor Cst. The reset circuit operates to maintain the Vref in the entire light emitting phase (t3). The Vth compensation signal generation is not affected by the pixel brightness signal Vdt to achieve the desired compensation effect. However, resetting the voltage at the terminal b of the storage capacitor Cst requires a separate reset transistor and the corresponding timing control. In addition, the voltage at the terminal b of the storage capacitor Cst is momentarily floated during the voltage resetting, which affects the stability of the voltage at the terminal b of the storage capacitor Cst.

When an AMOLED display terminal needs to precisely display two adjacent brightness levels Ln and Ln+1, the driving circuit (DrIC) also needs to produce the corresponding pixel brightness signals at a high resolution. For example, Vdt(Ln+1)−Vdt(Ln)<3 mV. The driving circuit (DrIC) may be costly in order to support such fine voltage resolution. As OLED current efficiency improves and higher image quality is demanded, the high voltage resolution of the driving circuit (DrIC) may cause the cost of the driving circuit DrIC go up unsustainably.

To this end, controlling the brightness of the entire screen through pulse width modulation (PWM) of the light emitting enable signal (EM) in the light emitting phase (t3) reduces the dependence on the pixel brightness signal resolution, and achieves finer brightness level distribution without requiring higher driving voltage resolution of the driving circuit (DrIC).

When pulse width modulation (PWM) is used to control the light emitting enable signal (EM) to turn off the reset transistor T6, the terminal b of the storage capacitor Cst is floated. The voltage at the floated terminal b may be unstable due to the likely parasitic capacitance coupling of extraneous signals. When the light emitting enable signal turns on the reset transistor T6 again, the voltage at the terminal a of the storage capacitor Cst may be affected accordingly to cause instability in the operation of the pixel circuit and undesired image quality.

In various embodiments, transistors described in the present disclosure may be, for example, thin film transistors, field effect transistors, or other similar components. The transistors may function as switching transistors in the pixel circuits according to various disclosed embodiments. Because a source electrode and a drain electrode in a switching transistor are symmetrical, the source electrode and the drain electrode are interchangeable.

In certain embodiments, in order to distinguish two electrodes other than the gate electrode, a source electrode is referred to as a first terminal and a drain electrode is refers to as a second terminal, or vice versa. In a figure showing transistor terminals, a middle terminal may be a gate electrode, a signal input terminal may be a source electrode, and a signal output terminal may be a drain electrode.

Further, switching transistors described in the present disclosure include P-type switching transistors and N-type switching transistors. A P-type switching transistor turns on when a low level voltage is applied to the gate electrode, and turns off when a high level voltage is applied to the gate electrode. An N-type switching transistor turns on when a high level voltage is applied to the gate electrode, and turns off when a low level voltage is applied to the gate electrode.

Driving transistors described in the present disclosure may include P-type driving transistors and N-type driving transistors. A P-type driving transistor may be in amplification state or saturation state when a low level voltage is applied to the gate electrode (making the gate electrode voltage lower than the source electrode voltage) and the absolute voltage difference between the gate electrode and the source electrode is greater than a threshold voltage. An N-type driving transistor may be in amplification state or saturation state when a high level voltage is applied to the gate electrode (making the gate electrode voltage higher than the source electrode voltage) and the absolute voltage difference between the gate electrode and the source electrode is greater than a threshold voltage.

Figure 3:
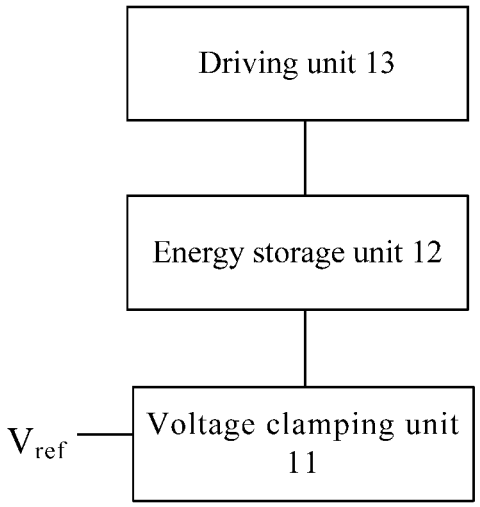
FIG. 3 is a schematic diagram illustrating an exemplary pixel circuit according to various disclosed embodiments of present disclosure.

FIG. 3 is a schematic diagram illustrating an exemplary pixel circuit according to the present disclosure. Referring to FIG. 3, the present disclosure provides a pixel circuit. The pixel circuit may include a voltage clamping unit 11, a driving unit 13, an energy storage unit 12, and a reference voltage terminal Vref.

In one embodiment, the voltage clamping unit 11 is connected to the reference voltage terminal Vref and a first terminal of the energy storage unit 12. A second terminal of the energy storage unit 12 supplies a signal to the driving unit 13. The voltage clamping unit 11 is used to form a voltage divider circuit to divide the voltage at the first terminal of the energy storage unit 12. Alternatively, the voltage at the first terminal of the energy storage unit 12 is driven and clamped to the reference voltage Vref.

In another embodiment, the voltage clamping unit 11 includes a clamping resistor Rc. A first terminal of the clamping resistor Rc is connected to the reference voltage terminal Vref. A second terminal of the clamping resistor Rc is connected to one terminal of the energy storage unit 12.

Figure 4:
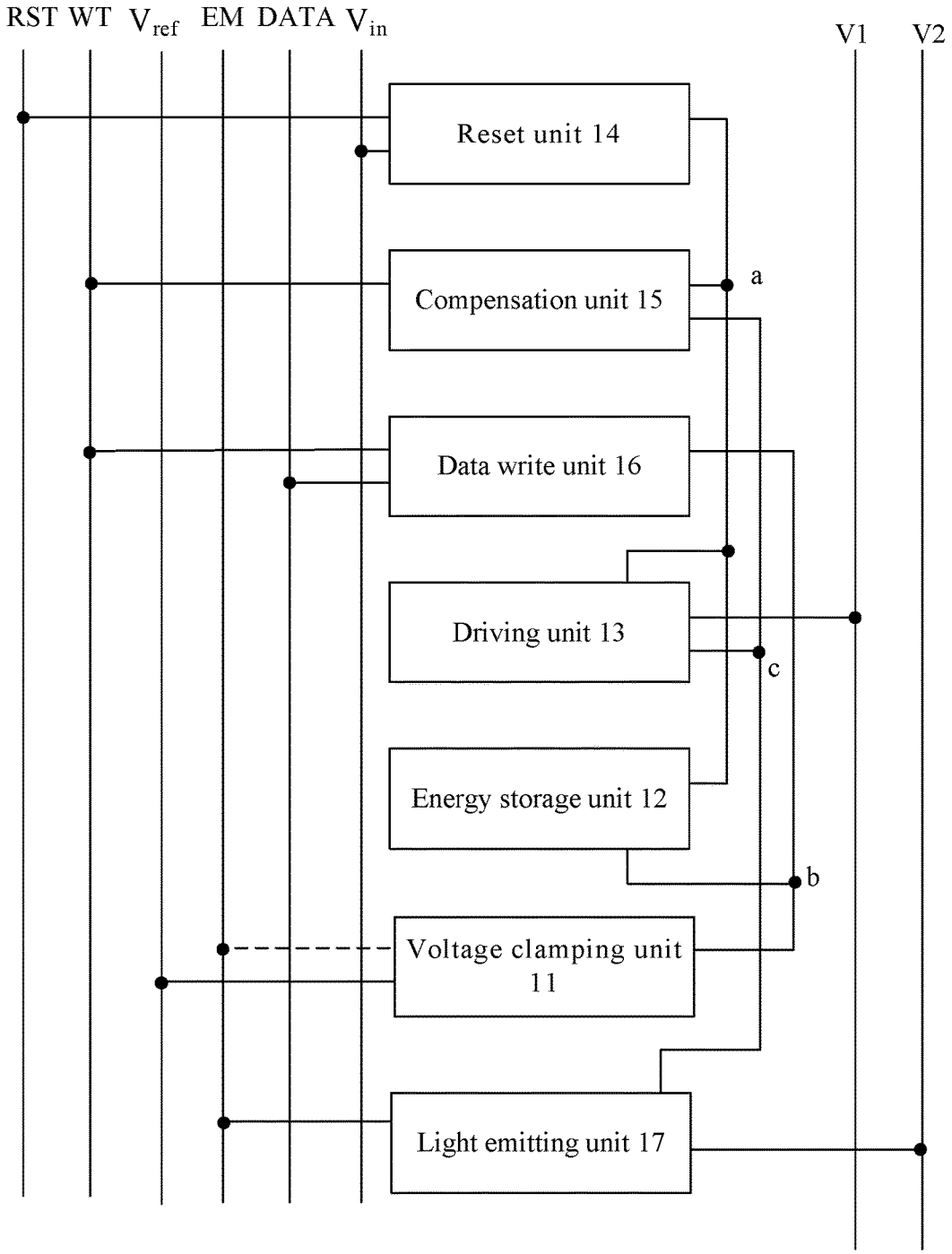
FIG. 4 is a schematic diagram illustrating another exemplary pixel circuit according to various disclosed embodiments of present disclosure.

FIG. 4 is a schematic diagram illustrating another exemplary pixel circuit according to the present disclosure. Referring to FIG. 4, the pixel circuit may also include a reset unit 14, a compensation unit 15, a data write unit 18, and a light emitting unit 17.

The reset unit 14 connects a reset control terminal RST, the second terminal a of the energy storage unit 12, and a reset voltage terminal Vin together. The reset unit 14 controls through the reset control terminal RST to write the reset voltage terminal signal Vin into the second terminal a of the energy storage unit 12.

The voltage clamping unit 11 includes a voltage divider circuit to divide the voltage at the first terminal b of the energy storage unit 12. Alternatively, the voltage of the first terminal b of the energy storage unit 12 is driven and clamped to the reference voltage Vref at the reference voltage terminal. When the voltage clamping unit 11 divides the voltage at the first terminal b of the energy storage unit 12, the voltage clamping unit 11 can divide the signal voltage that a data signal terminal writes at the first terminal b of the energy storage unit 12.

The data write unit 16 connects the data signal terminal DATA, a data write control terminal WT, and the first terminal b of the energy storage unit 12 together. The data write unit 16 controls through the data write control terminal WT to write the divided signal voltage at the data signal terminal DATA into the first terminal b of the energy storage unit 12.

The compensation unit 15 connects the data write control terminal WT, the second terminal a of the energy storage unit 12, and a driving terminal c together. The compensation unit 15 controls through the data write control terminal WT to drive the voltage at the second terminal a of the energy storage unit 12 to a same level as the voltage at the driving terminal c.

The energy storage unit 12 is used to store the voltages at the first terminal and the second terminal of the energy storage unit 12.

The driving unit 13 connects a first voltage terminal V1, the second terminal a of the energy storage unit 12, and the driving terminal c together. The driving unit 13 controls through the second terminal a of the energy storage unit 12 to write the voltage at the first voltage terminal V1 into the driving terminal c as a driving signal.

The light emitting unit 17 connects a light emitting control signal terminal EM, the driving terminal c, and a second voltage terminal V2 together. The light emitting unit 17 controls through the light emitting control signal terminal to receive the driving signal at the driving terminal c to display a gray scale.

In the pixel circuit according to various embodiments, the voltage clamping unit connects the reference voltage terminal and the first terminal of the energy storage unit. When the pixel circuit drives an OLED pixel, the voltage clamping unit may divide the voltage at the first terminal of the energy storage unit or write the voltage at the voltage reference terminal into the first terminal of the energy storage unit to avoid floating the first terminal of the energy storage unit during the pixel circuit operation, to increase the voltage stability at the first terminal of the energy storage unit, and to improve image quality.

Figure 5:
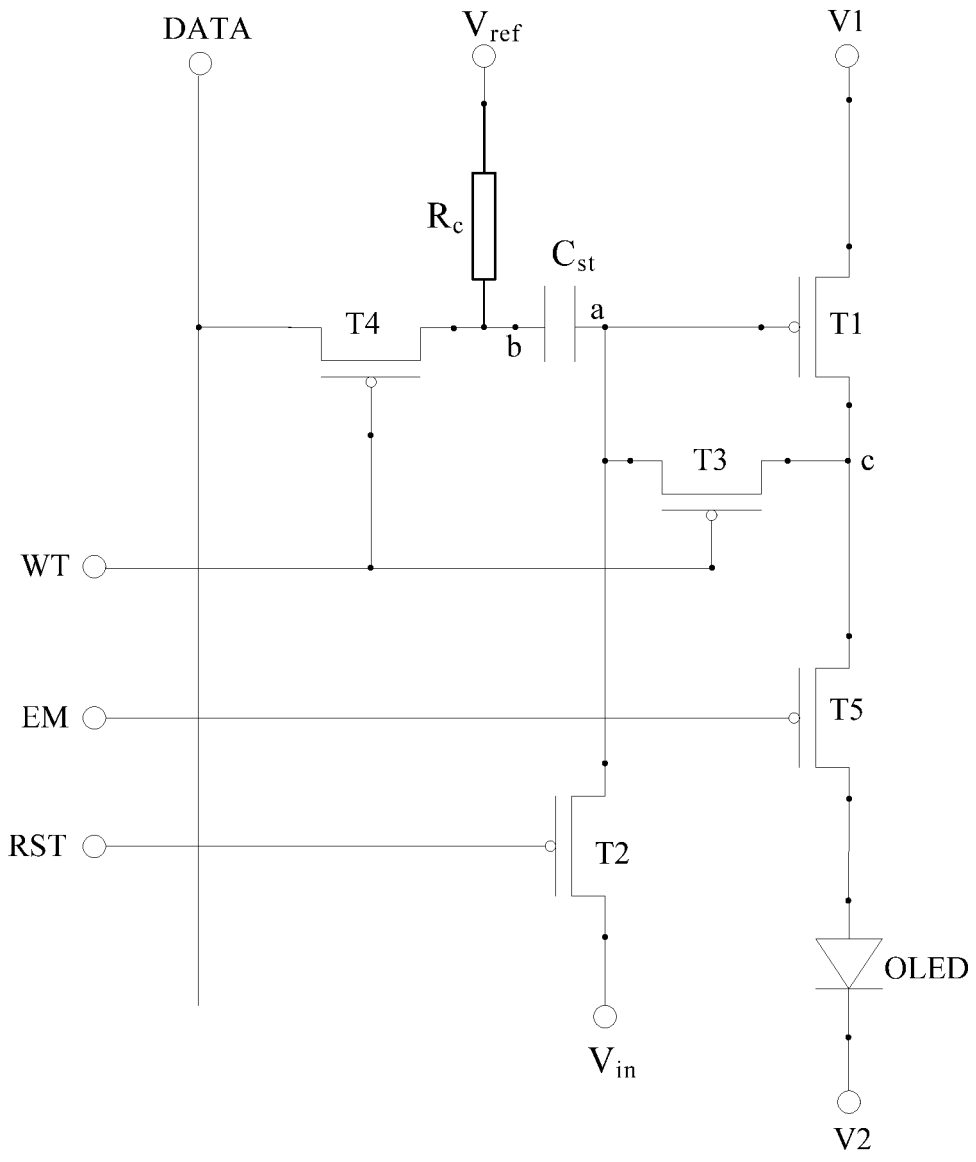
FIG. 5 is a schematic diagram illustrating another exemplary pixel circuit according to various disclosed embodiments of present disclosure.

FIG. 5 is a schematic diagram illustrating another exemplary pixel circuit according to the present disclosure. Specifically, referring to FIG. 5, the driving unit 13 includes a first transistor T1. A control terminal of the first transistor T1 is connected to a second terminal a of the energy storage unit 12. A first terminal of the first transistor T1 is connected to a first voltage terminal V1. A second terminal a of the energy storage unit 12 is connected to a driving terminal c.

The reset unit 14 includes a second transistor T2. A control terminal of the second transistor T2 is connected to a reset control terminal RST. A first terminal of the second transistor T2 is connected to a reset voltage terminal Vin. A second terminal of the second transistor T2 is connected to the second terminal a of the energy storage unit 12.

The compensation unit 15 includes a third transistor T3. A control terminal of the third transistor T3 is connected to a data write control terminal WT. A first terminal of the third transistor T3 is connected to the driving terminal c. A second terminal of the third transistor 1T3 is connected to the second terminal a of the energy storage unit 12.

The data write unit 16 includes a fourth transistor T4. A control terminal of the fourth transistor T4 is connected to the data write control terminal WT. A first terminal of the fourth transistor T4 is connected to a data signal terminal DATA. A second terminal of the fourth transistor T4 is connected to a first terminal b of the energy storage unit 12.

The light emitting unit 17 includes a fifth transistor T5 and an organic light emitting diode (OLED). A control terminal of the fifth transistor T5 is connected to a light emitting control signal terminal EM. A first terminal of the fifth transistor T5 is connected to the driving terminal c. A second terminal of the fifth transistor T5 is connected to a first terminal of the OLED. A second terminal of the OLED is connected to a second voltage terminal V2.

The energy storage unit 12 includes a capacitor Cst. A first terminal of the storage capacitor Cst is connected to the second terminal a of the energy storage unit 12. A second terminal of the storage capacitor Cst is connected to the first terminal b of the energy storage unit 12.

The voltage clamping unit 11 includes a clamping resistor Rc. A first terminal of the clamping resistor Rc is connected to a reference voltage terminal Vref. A second terminal of the clamping resistor Rc is connected to a first terminal b of the energy storage unit 12.

Figure 6:
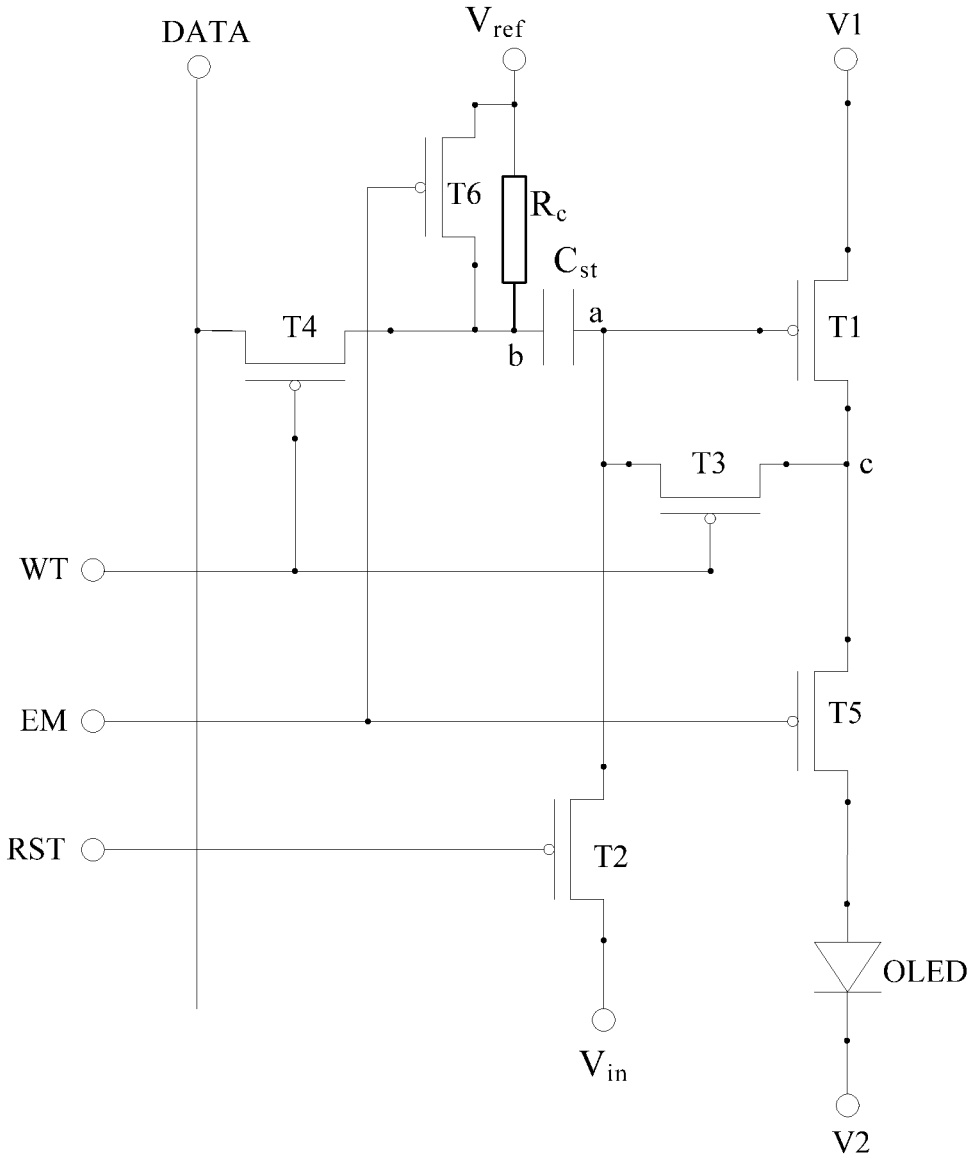
FIG. 6 is a schematic diagram illustrating another exemplary pixel circuit according to various disclosed embodiments of present disclosure.

FIG. 6 is a schematic diagram illustrating another exemplary pixel circuit according to the present disclosure. Referring to FIG. 6, the pixel circuit is different from the pixel circuit shown in FIG. 5. Specifically, the voltage clamping unit 11 also connects to the light emitting control signal terminal EM. The voltage clamping unit 11 controls through the light emitting control signal terminal EM to drive the voltage at the first terminal b of the energy storage unit 12 to a same level as the voltage at the first terminal b of the energy storage unit 12.

Specifically, the voltage clamping unit 11 includes a clamping resistor Rc and a sixth transistor T6. A first terminal of the clamping resistor Rc is connected to the reference voltage terminal Vref. A second terminal of the clamping resistor Rc is connected to the first terminal b of the energy storage unit 12. A control terminal of the sixth transistor T6 is connected to a light emitting control signal terminal EM. A first terminal of the sixth transistor T6 is connected to the reference voltage terminal Vref, A second terminal of the sixth transistor T6 is connected to the first terminal b of the energy storage unit 12.

Further, in the pixel circuits as shown in FIG. 5 or FIG. 6, the clamping resistor Rc may be fabricated in any of the following processes. The clamping resistor may be formed by an ion implantation low temperature polysilicon film. Alternatively, the clamping resistor may be formed by thin film material having predetermined thin film resistor values. Alternatively, the clamping resistor may be formed simultaneously when a P+ doped region of an active layer of the transistor is formed, where the dopant implantation dosage in the doped region of the active layer of the transistor is greater than the dopant implantation dosage in the thin film resistor region of the clamping resistor.

Resistors may be formed by implanting ions into low temperature polysilicon thin film. Because the ion implantation dosage for resistor fabrication is different from hole dopant implantation dosage and ion implantation for channel in regular low temperature polysilicon thin film transistor fabrication process, a streamlined method is to perform a separate photographic patterning process to form a shape of resistor thin film with a separately controlled ion implantation dosage. Further, practically, forming the shape of the ion implantation region may share a same mask with other photographic patterning process, and may combine with other fabrication process. Even the ion implantation dosage may be adjusted for specific region by using half tone or grey tone techniques.

For example, a regular P+ region may be formed by a photographic patterning and ion implantation process. By using the half tone or the grey tone technique, at the same time, a resistor thin film region may be formed in a desired shape keeping a certain thickness of the photoresist layer. When a hole dopant is implanted, the remaining photoresist layer may reduce the implantation dosage in the resistor thin film region as compared to the regular hole dopant implantation region. This method or other similar methods may eliminate the add-on cost for the clamping resistor formation. Alternatively, thin film material having certain thin film resistance value may be used to form the clamping resistor.

Figure 8:
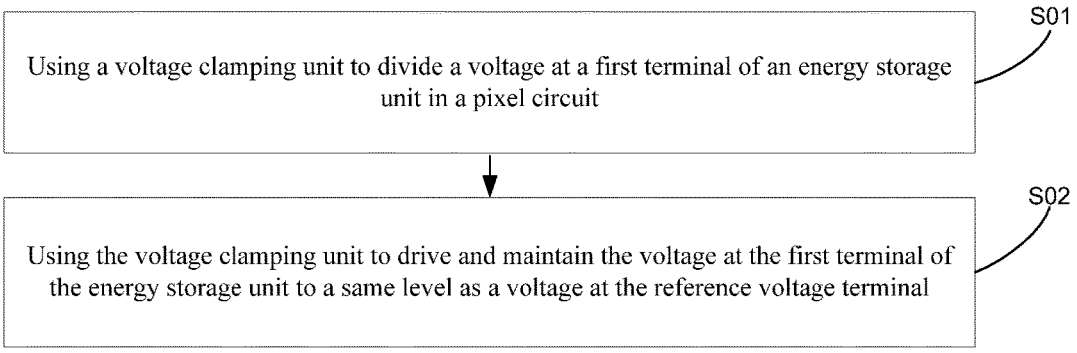
FIG. 8 is a flow chart illustrating a driving method for an exemplary pixel circuit according to various disclosed embodiments of present disclosure.

The present disclosure also provides a driving method for the pixel circuit according to various disclosed embodiments. FIG. 8 is a flow chart illustrating a driving method for an exemplary pixel circuit according to the present disclosure. As shown in FIG. 8, the driving method may include the following steps.

Step S01: using a voltage clamping unit to divide a voltage at a first terminal of an energy storage unit in a pixel circuit.

Specifically, as shown in FIG. 5, the voltage clamping unit 11 includes a clamping resistor Rc. The first terminal of the clamping resistor Rc is connected to the reference voltage terminal Vref. The second terminal of the clamping resistor Rc is connected to the first terminal b of the energy storage unit 12. The voltage clamping unit 11 divides the voltage at the first terminal of the energy storage unit 12.

Step S02: using the voltage clamping unit to drive and maintain the voltage at the first terminal of the energy storage unit to a same level as a voltage at the reference voltage terminal.

Specifically, as shown in FIG. 6, the voltage clamping unit 11 includes the clamping resistor Rc and the sixth transistor T6. The first terminal of the clamping resistor Rc is connected to the reference voltage terminal Vref. The second terminal of the clamping resistor Rc is connected to the first terminal b of the energy storage unit 12. The control terminal of the sixth transistor T6 is connected to the light emitting control signal terminal EM. The first terminal of the sixth transistor T6 is connected to the reference voltage terminal Vref. The second terminal of the sixth transistor T6 is connected to the first terminal b of the energy storage unit 12. The voltage clamping unit 11 drives and maintains the voltage at the first terminal of the energy storage unit to a same level as the voltage at the reference voltage terminal.

In the pixel circuit driving method according to various embodiments, the voltage clamping unit connects the reference voltage terminal and the first terminal of the energy storage unit. When the pixel circuit drives an OLED pixel, the voltage clamping unit may divide the voltage at the first terminal of the energy storage unit or write the voltage at the voltage reference terminal into the first terminal of the energy storage unit to avoid floating the first terminal of the energy storage unit during the pixel circuit operation, to increase the voltage stability at the first terminal of the energy storage unit, and to improve image quality.

Specifically, the pixel circuit driving method further includes other details in the following steps.

Step S101: a reset unit controls through a reset control terminal to write a voltage at a reset voltage terminal into a second terminal of an energy storage unit.

Specifically, as shown in FIG. 4, the reset unit 14 connects the reset control terminal RST, the second terminal a of the energy storage unit 12, and the reset voltage terminal Vin together. The reset unit 14 controls through the reset control terminal RST to write the reset voltage terminal signal Vin into the second terminal a of the energy storage unit 12.

Step S102: a data write unit controls through a data write control terminal to write a divided signal voltage at a data signal terminal into a first terminal of the energy storage unit, a voltage clamping unit divides a signal voltage that the data signal terminal writes at the first terminal of the energy storage unit, a compensation unit controls through the data write control terminal to drive the voltage at the second terminal of the energy storage unit to a same level as a voltage at a driving terminal, and the energy storage unit stores the voltages at the first terminal and the second terminal of the energy storage unit.

Specifically, as shown in FIG. 4, the data write unit 16 connects the data signal terminal DATA, the data write control terminal WT, and the first terminal b of the energy storage unit 12 together. The data write unit 16 controls through the data write control terminal WT to write the divided signal voltage at the data signal terminal DATA into the first terminal b of the energy storage unit 12. The voltage clamping unit 11 includes the voltage divider circuit to divide the voltage at the first terminal b of the energy storage unit 12. Alternatively, the voltage of the first terminal b of the energy storage unit 12 is driven and clamped to the reference voltage Vref at the reference voltage terminal. When the voltage clamping unit 11 divides the voltage at the first terminal b of the energy storage unit 12, the voltage clamping unit 11 can divide the signal voltage that a data signal terminal writes at the first terminal b of the energy storage unit 12.

Further, the compensation unit 15 connects the data write control terminal WT, the second terminal a of the energy storage unit 12, and the driving terminal c together. The compensation unit 15 controls through the data write control terminal WT to drive the voltage at the second terminal a of the energy storage unit 12 to a same level as the voltage at the driving terminal c. The energy storage unit 12 is used to store the voltages at the first terminal and the second terminal of the energy storage unit 12.

Step S103: a driving unit controls through the second terminal of the energy storage unit to write a voltage at a first voltage terminal into the driving terminal as a driving signal, and a light emitting unit controls through a light emitting control signal terminal to receive the driving signal at the driving terminal to display a gray scale.

Specifically, as shown in FIG. 4, the driving unit 13 connects the first voltage terminal V1, the second terminal a of the energy storage unit 12, and the driving terminal c together. The driving unit 13 controls through the second terminal a of the energy storage unit 12 to write the voltage at the first voltage terminal V1 into the driving terminal c as a driving signal. The light emitting unit 17 connects the light emitting control signal terminal EM, the driving terminal c, and the second voltage terminal V2 together. The light emitting unit 17 controls through the light emitting control signal terminal to receive the driving signal at the driving terminal c to display a gray scale.

In one embodiment, the reset unit includes a second transistor. In the step S101, controlled by the reset control terminal, the second transistor turns on, and writes a voltage at the reset voltage terminal into the second terminal of the energy storage unit.

In another embodiment, the compensation unit includes a third transistor. In the step S102, controlled by the data write control terminal, the third transistor turns on, and pulls the voltage at the second terminal of the energy storage unit to a same level as the voltage at the driving terminal.

In another embodiment, the data write unit includes a fourth transistor. In the step S102, controlled by the data write control terminal, the fourth transistor turns on, and writes the voltage at the data signal terminal to the first terminal of the energy storage unit.

In another embodiment, the light emitting unit includes a fifth transistor and an organic light emitting diode. In the step S103, controlled by the light emitting control signal terminal, the fifth transistor turns on, and receives the driving signal from the driving terminal. Controlled by the driving signal and the signal at the second voltage terminal, the organic light emitting diode displays a gray scale.

In another embodiment, the voltage clamping unit includes a clamping resistor. In the step S102, the clamping resistor divides the voltage at the first terminal of the energy storage unit. In the step S103, the clamping resistor pulls the voltage at first terminal of the energy storage unit to the voltage level at the reference voltage terminal.

In another embodiment, the voltage clamping unit includes a clamping resistor and a sixth transistor. In the step S102, the clamping resistor divides the voltage at the first terminal of the energy storage unit. In the step S103, controlled by the light emitting control signal terminal, the sixth transistor turns on, shorts the clamping resistor, and pulls the voltage at the first terminal of the energy storage unit to the voltage level at the reference voltage terminal.

Figure 7:
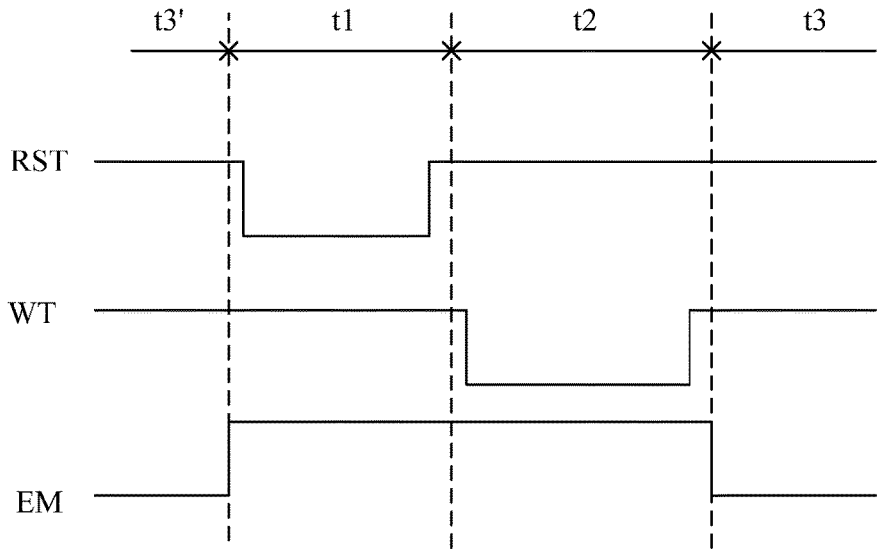
FIG. 7 is a timing diagram illustrating a driving signal of an exemplary pixel circuit according to various disclosed embodiments of present disclosure.

FIG. 7 is a timing diagram illustrating a driving signal of an exemplary pixel circuit according to the present disclosure. Referring to FIG. 7, the operation principle of the pixel circuit shown in FIG. 5 is illustrated in the context of the driving signal timing sequence. P-type transistors are assumed in the illustrations of the pixel circuits shown in FIGS. 5-6 although the present disclosure does not limit the transistor type. P-type transistors may be substituted by N-type transistors with simple changes to the switching signals. Either type of transistors are within the scope of present disclosure.

Specifically, in a t1 phase or a reset phase, RST is a low voltage signal, WT is a high voltage signal, and EM is a high voltage signal. Controlled by RST, the transistor T2 turns on and pulls a voltage at the terminal a to an initial voltage Vint to ensure that, in a t2 phase, the driving transistor T1 properly charges the terminal a and writes the threshold voltage Vth to the terminal a consistently. In the t1 phase, the circuit state in a previous frame or in a phase t3' as shown in FIG. 7 is cleared and the residual charge in the storage capacitor Cst is discharged.

In a t2 phase or a write phase, RST is a high voltage signal, WT is a low voltage signal, and EM is a high voltage signal. Controlled by WT, the transistors T3 and T4 turn on. The driving circuit (DrIC) generates a pixel brightness voltage Vdt. The pixel brightness signal Vdt at the DATA line charges the terminal b of the storage capacitor Cst through the transistor T4. The charging circuit internal resistor Rin and the clamping resistor Rc are connected in series. The voltage at the terminal b of the storage capacitor Cst is a voltage V'dt divided by the resistor Rin and resistor Rc connected in series.

At the same time, the transistor T1 charges the driving terminal c and the terminal a of the storage capacitor Cst, and writes a compensation signal Vth to the driving terminal c and the terminal a of the storage capacitor Cst. The compensation signal Vth is a threshold voltage of the transistor T1. Specifically, the source electrode of the transistor T1 is connected to the first voltage terminal V1 and maintains the driving voltage Vdd from the first voltage terminal. The drain electrode and the gate electrode of the transistor T1 are shorted by the transistor T3 in on state, and are connected to the terminal a of the storage capacitor Cst. The voltage at the terminal a of the storage capacitor Cst is charged to approach the threshold voltage Vth. The approximate threshold voltage Vth is stored by the storage capacitor Cst.

In a t3 phase or a light emitting phase, RST is a high voltage signal, WT is a high voltage signal, and EM is a low voltage signal. Controlled by EM, the transistor T5 turns on. Controlled by WT, the transistors T3 and T4 turn off. The voltage V'dt at the terminal b of the storage capacitor Cst is pulled and clamped to the reference voltage Vref by the clamping resistor Rc. The voltage at the terminal a of the storage capacitor Cst changes by a same amount to Vref−V'dt due to the capacitor Cst coupling. The voltage at the terminal a of the storage capacitor Cst turns on the transistor T1 to drive the OLED to emit light. Because the transistor T1 threshold voltage is compensated in the t2 phase, the transistor T1 is able to properly drive the OLED to emit light.

Further, referring to FIG. 6, the pixel circuit also includes a transistor T6 connected to the clamping resistor in parallel. In the t3 phase, controlled by EM, the transistor T6 turns on. In this case, the clamping resistor takes effect only when the transistor T6 transitions between the on and off states to avoid floating the terminal b of the storage capacitor Cst and the subsequent instability. In addition, in the t3 phase, it is the transistor T6 that pulls the voltage at the terminal b of the storage capacitor Cst. The clamping resistor Rc only plays a limited role in avoiding floating the terminal b of the storage capacitor Cst during the state transition of the transistor T6 or when the transistor T6 turns off.

In various embodiments, the resistance value of the clamping resistor Rc may be calculated as follows.

The voltage at the terminal b of the storage capacitor Cst is a divided voltage V'dt of the DrIC generated pixel brightness signal Vdt by the charging circuit internal resistor Rin and the clamping resistor connected in series. Thus, the voltage V'dt may be affected by many factors.

In one aspect, the charging circuit internal resistor Rin is the equivalent internal resistor of the pixel circuit before the first terminal of the storage capacitor Cst. That is the combined resistance from the DrIC to the terminal b of the storage capacitor Cst, including the resistance along the data line, and the on state resistance of the transistor T4. In the case that the DrIC already transmits the pixel brightness signal Vdt to the corresponding data line before the transistor T4 turns on and the parasitic capacitance of the data line is substantially greater than the pixel signal storage capacitance, writing Vdt is equivalent to charging the storage capacitor Cst by the parasitic capacitor. The charging circuit internal resistance Rin primarily includes the on state resistance of the transistor T4.

Taking into account the inconsistency in the Rin and Rc fabrication process, the resulted inconsistent V'dt value and pixel brightness accuracy, the Rc resistance is designed to be substantially greater than the Rin resistance. As a result, the divided voltage V'dt will closely approach the driving source signal voltage to minimize the effect caused by the inconsistent resistance values.

In another aspect, when the Rc resistance is too large, it may take too long to drive and clamp the voltage at the terminal b of the storage capacitor Cst to the reference voltage Vref in the t3 phase. When the charging time through the clamping resistor Rc takes a significant portion of the frame period (Tframe), the Rc resistance inconsistency may affect the pixel brightness accuracy.

In order to ensure the pixel brightness accuracy, the time period for pulling and clamping the voltage at the terminal b of the storage capacitor Cst through the clamping resistor Rc must be as short as possible. From the perspective of equivalent circuit, when the voltage at the terminal b of the storage capacitor Cst is pulled or reset, the voltage at the reference voltage terminal Vref practically charges a network of a parasitic capacitor $C_{pB}$ at the terminal b, the storage capacitor Cst, and a parasitic capacitor $C_{pA}$ at the terminal a through the clamping resistor Rc.

When the storage capacitor Cst has a substantially greater capacitance than the parasitic capacitor $C_{pB}$ at the terminal b and the parasitic capacitor $C_{pA}$ at the terminal a, the capacitor network has an equivalent capacitance equal to the sum of the $C_{pB}$ capacitance and the $C_{pA}$ capacitance. In this case, the charging time constant is given as $\tau \approx R_c*(C_{pA}+C_{pB})$.

As long as the charging time constant r is substantially smaller than the frame period $T_{frame}$, i.e., $R_c \ll T_{frame}/(C_{pA}+C_{pB})$, the undesired effect of the terminal b charging time constant inconsistency caused by the inconsistent resistance Rc may be minimized.

Under different circumstances, such as different fabrication processes, different screen sizes, and different display resolutions, etc., the clamping resistor Rc value selection may be different. Based on the actual design requirements, the clamping resistor Rc value selection maybe optimized by balancing the two aspects described above.

The present disclosure also provides an array substrate. The array substrate includes a pixel circuit according to various embodiments.

The present disclosure also provides a display panel. The display panel includes a pixel circuit according to various embodiments.

The present disclosure also provides a display device. The display device includes a display panel according to various embodiments. The display device may be an electronic paper, a smart phone, a tablet computer, a television set, a monitor, a notebook computer, a digital picture frame, a navigation device, or any products or components having display function.

The foregoing description of the embodiments of the disclosure has been presented for purposes of illustration and description. It is not intended to be exhaustive or to limit the disclosure to the precise form or to exemplary embodiments disclosed. Accordingly, the foregoing description should be regarded as illustrative rather than restrictive. Obviously, many modifications and variations may be apparent to practitioners skilled in this art. The embodiments are chosen and described in order to best explain the principles of the disclosure and its best mode practical application, thereby to enable persons skilled in the art to understand the disclosure for various embodiments and with various modifications as are suited to the particular use or implementation contemplated. It is intended that the scope of the disclosure be defined by the claims appended hereto and their equivalents in which all terms are meant in their broadest reasonable sense unless otherwise indicated. Therefore, the term "the disclosure", "the present disclosure" or the like does not necessarily limit the claim scope to a specific embodiment, and the reference to exemplary embodiments of the disclosure does not imply a limitation on the disclosure, and no such limitation is to be inferred. The disclosure is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the disclosure. It should be appreciated that variations may be made in the embodiments described by persons skilled in the art without departing from the scope of the present disclosure as defined by the following claims. Moreover, no element and component in the present disclosure is intended to be dedicated to the public regardless of whether the element or component is explicitly recited in the following claims.

What is claimed is:

1. A pixel circuit, comprising:

a voltage clamping circuit;

an energy storage circuit; and a reference voltage terminal, wherein:

the voltage clamping circuit is configured to connect to the reference voltage terminal and a first terminal of the energy storage circuit;

the voltage clamping circuit is configured to form a voltage divider circuit to supply a divided reference voltage from the reference voltage terminal to the first terminal of the energy storage circuit, or to pull and clamp a voltage at the first terminal of the energy storage circuit to a reference voltage at the reference voltage terminal, the voltage clamping circuit includes a clamping resistor;

a first terminal of the clamping resistor is configured to connect to the reference voltage terminal;

a second terminal of the clamping resistor is configured to connect to the first terminal of the energy storage circuit;

the clamping resistor has a resistance value selected to satisfy one or more of a first condition and a second condition;

the first condition includes $R_c >> R_{in}$, where $R_c$ is the resistance value of the clamping resistor, and $R_{in}$ is an accumulative internal resistance in the pixel circuit before the first terminal of the energy storage circuit; and the second condition includes $R_c << T_{frame}/(C_{pA}+C_{pB})$, where $R_c$ is the resistance value of the clamping resistor, $T_{frame}$ is a frame period $C_{PA}$ is a parasitic capacitance at the second terminal of the energy storage circuit, and $C_{pB}$ is a parasitic capacitance at the first terminal of the energy storage circuit.

2. The pixel circuit of claim 1, further including a reset circuit, wherein:

the reset circuit is configured to connect a reset control terminal, a second terminal of the energy storage circuit, and a reset voltage terminal together; and controlled by the reset control terminal, the reset circuit is configured to write a signal at the reset voltage terminal to the second terminal of the energy storage circuit.

3. The pixel circuit of claim 2, wherein:

the reset circuit includes a second transistor;

a control terminal of the second transistor connects to the reset control terminal;

a first terminal of the second transistor connects to the reset voltage terminal; and a second terminal of the second transistor connects to the second terminal of the energy storage circuit.

4. The pixel circuit of claim 1, further including a data write circuit, wherein:

the data write circuit is configured to connect a data signal terminal, a data write control terminal, and the first terminal of the energy storage circuit together; and controlled by the data write control terminal, the data write circuit is configured to write a divided signal at the data signal terminal to the first terminal of the energy storage circuit.

5. The pixel circuit of claim 4, wherein:

the data write circuit includes a fourth transistor;

a control terminal of the fourth transistor connects to the data write control terminal;

a first terminal of the fourth transistor connects to the data signal terminal; and a second terminal of the fourth transistor connects to the first terminal of the energy storage circuit.

6. The pixel circuit of claim 1, further including a compensation circuit, wherein:

the compensation circuit is configured to connect the data write control terminal, a second terminal of the energy storage circuit, and a driving terminal together; and controlled by the data write control terminal, the compensation circuit is configured to pull a voltage at the second terminal of the energy storage circuit to a same level as a voltage at the driving terminal.

7. The pixel circuit of claim 6, wherein:

the compensation circuit includes a third transistor;

a control terminal of the third transistor connects to the data write control terminal;

a first terminal of the third transistor connects to the driving terminal; and a second terminal of the third transistor connects to the second terminal of the energy storage circuit.

8. The pixel circuit of claim 1, further including a driving circuit, wherein:

the driving circuit is configured to connect a first voltage terminal, a second terminal of the energy storage circuit, and the driving terminal together; and controlled by the second terminal of the energy storage circuit and the first voltage terminal, the driving circuit is configured to output a driving signal to the driving terminal.

9. The pixel circuit of claim 8, further including a light emitting circuit, wherein:

the light emitting circuit is configured to connect a light emitting control signal terminal, the driving terminal, and a second voltage terminal together; and controlled by the light emitting control signal terminal, the light emitting circuit is configured to receive the driving signal from the driving terminal to display a gray scale.

10. The pixel circuit of claim 9, wherein:

the voltage clamping circuit also connects to the light emitting control signal terminal; and controlled by the light emitting control signal terminal, the voltage clamping circuit is configured to pull the voltage at the first terminal of the energy storage circuit to a same level as a voltage level at the reference voltage terminal.

11. The pixel circuit of claim 10, wherein:

the voltage clamping circuit includes a clamping resistor and a sixth transistor;

a first terminal of the clamping resistor connects to the reference voltage terminal;

a second terminal of the clamping resistor connects to the first terminal of the energy storage circuit;

a control terminal of the sixth transistor connects to the light emitting control signal terminal;

a first terminal of the sixth transistor connects the reference voltage terminal; and a second terminal of the sixth transistor connects to the first terminal of the energy storage circuit.

12. The pixel circuit of claim 9, wherein:

the light emitting circuit includes a fifth transistor and an organic light emitting diode;

a control terminal of the fifth transistor connects to the light emitting control signal terminal;

a first terminal of the fifth transistor connects to the driving terminal;

a second terminal of the fifth transistor connects to a first terminal of the organic light emitting diode; and a second terminal of the organic light emitting diode connects to the second voltage terminal.

13. The pixel circuit of claim 8, wherein:

the driving circuit includes a first transistor;

a control terminal of the first transistor connects to the second terminal of the energy storage circuit;

a first terminal of the first transistor connects to the first voltage terminal; and a second terminal of the first transistor connects to the driving terminal.

14. The pixel circuit of claim 1, wherein:

the energy storage circuit includes a capacitor;

a first terminal of the capacitor connects to a second terminal of the energy storage circuit; and a second terminal of the capacitor connects to the first terminal of the energy storage circuit.

15. An array substrate, comprising the pixel circuit of claim 1.

16. A display panel, comprising the pixel circuit of claim 1.

17. A method for driving a pixel circuit comprising a voltage clamping circuit; an energy storage circuit; and a reference voltage terminal, the method comprising:

using the voltage clamping circuit to either divide a voltage at a first terminal of the energy storage circuit in the pixel circuit or to drive and maintain the voltage at the first terminal of the energy storage circuit to a same level as a voltage at the reference voltage terminal, wherein the voltage clamping circuit includes a clamping resistor;

a first terminal of the clamping resistor is configured to connect to the reference voltage terminal;

a second terminal of the clamping resistor is configured to connect to the first terminal of the energy storage circuit;

the clamping resistor has a resistance value selected to satisfy one or more of a first condition and a second condition;

the first condition includes $R_c >> R_{in}$ where $R_c$ is the resistance value of the clamping resistor, and $R_{in}$ is an accumulative internal resistance in the pixel circuit before the first terminal of the energy storage circuit and the second condition includes $R_c << T_{frame}/(C_{pA}+C_{pB})$, where $R_c$ is the resistance value of the clamping resistor, $T_{frame}$ is a frame period, $C_{pA}$ is a parasitic capacitance at the second terminal of the energy storage circuit, and $C_{pB}$ is a parasitic capacitance at the first terminal of the energy storage circuit.

18. The method of claim 17, further including:

using a reset circuit, under a control of a reset control terminal, to write a voltage at a reset voltage terminal into a second terminal of an energy storage circuit;

using a data write circuit, under a control of a data write control terminal, to write a divided signal voltage at a data signal terminal into a first terminal of the energy storage circuit; using a voltage clamping circuit to divide a signal voltage that the data signal terminal writes at the first terminal of the energy storage circuit; using a compensation circuit, under a control of the data write control terminal, to drive the voltage at the second terminal of the energy storage circuit to a same level as a voltage at a driving terminal, and using the energy storage circuit to store the voltages at the first terminal and the second terminal of the energy storage circuit; and using a driving circuit, under a control of the second terminal of the energy storage circuit, to write a voltage at a first voltage terminal into the driving terminal as a driving signal, and using a light emitting circuit, under a control of a light emitting control signal terminal, to receive the driving signal at the driving terminal to display a gray scale.

* * * * *